United States Patent [19]

Hellstrom

[11] 3,948,394

[45] Apr. 6, 1976

[54] CHILD-PROOFED QUICK-OPENING PACKAGE

[76] Inventor: H. Richard Hellstrom, 5245 Center Ave., Pittsburgh, Pa. 15232

[22] Filed: Sept. 28, 1973

[21] Appl. No.: 401,835

[52] U.S. Cl. ..... 206/531; 206/530; 206/532; 128/335.5

[51] Int. Cl.[2] ..... B65D 85/00

[58] Field of Search ..... 206/530, 531, 532, 534.1, 206/534.2, 498; 128/335.5

[56] References Cited

UNITED STATES PATENTS

| | | | |
|---|---|---|---|
| 2,968,391 | 1/1961 | Sparks | 206/532 |
| 3,207,299 | 9/1965 | Sparks | 206/532 |
| 3,472,367 | 10/1969 | Hellstrom | 206/538 |
| 3,521,805 | 7/1970 | Ward | 206/532 |
| 3,540,579 | 11/1970 | Hellstrom | 206/530 |
| 3,689,458 | 9/1972 | Hellstrom | 206/538 |
| 3,809,221 | 5/1974 | Compere | 206/498 |

*Primary Examiner*—William Price
*Assistant Examiner*—Joseph M. Moy
*Attorney, Agent, or Firm*—Donn J. Smith

[57] ABSTRACT

A quick-opening package comprises a layer of formable material, at least one pocket in the formable layer, and a frangible backing layer adhered to the formable layer for enclosing an item contained in the pocket. An arrangement is provided for strengthening portions of the formable layer, and the strengthening arrangement defines an angulation fold line extending between the formable layer portions and across the pocket. A layer of protective material is adhered at least peripherally to a side of the frangible layer opposite from the formable layer. The protective layer has a line of weakening therein extending adjacent to and generally parallel with the fold line of the package.

28 Claims, 21 Drawing Figures

FIG.1
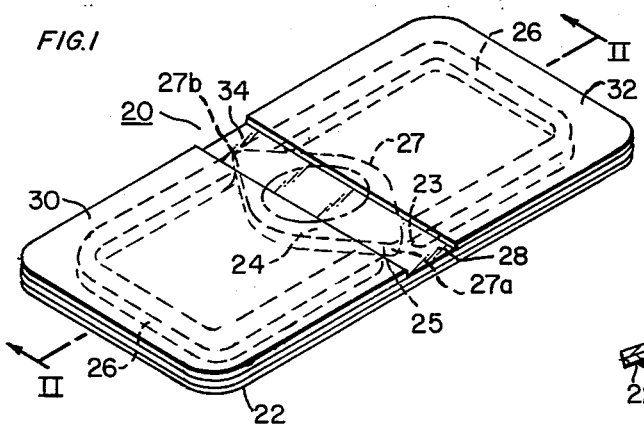
FIG.2
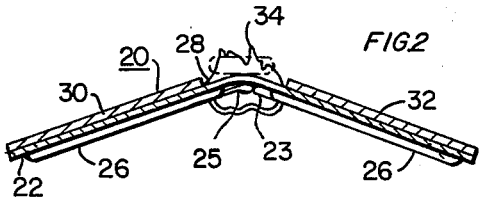
FIG.3
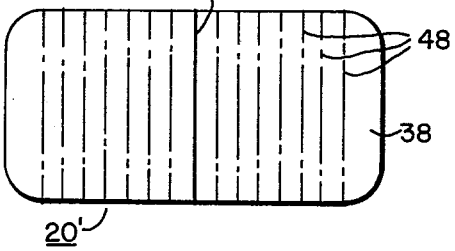
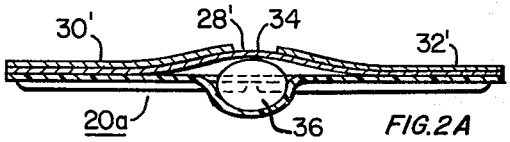
FIG.2A
FIG.5
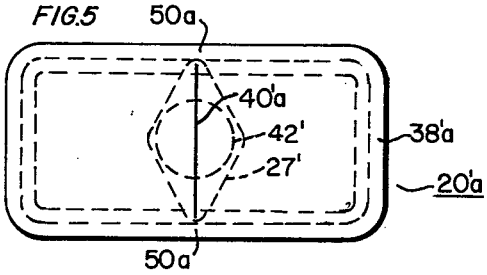
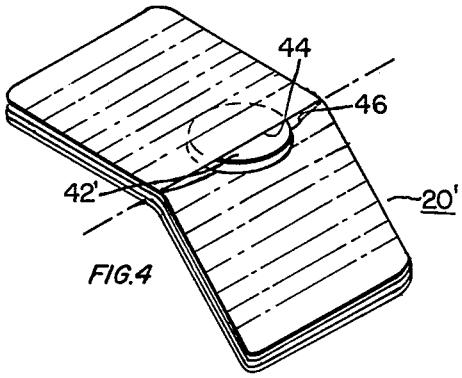
FIG.4
FIG.6
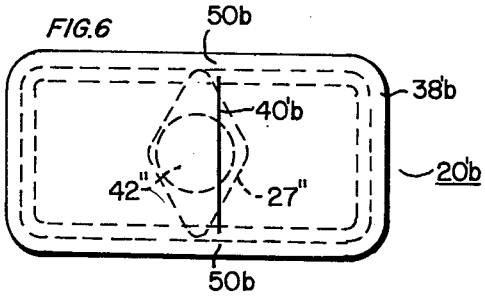
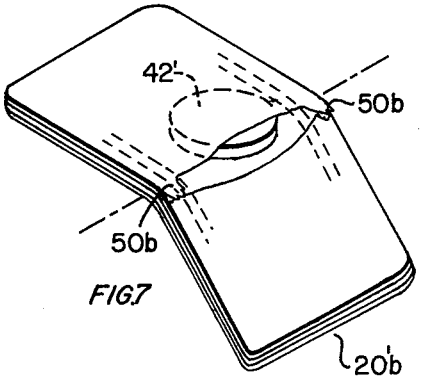
FIG.7

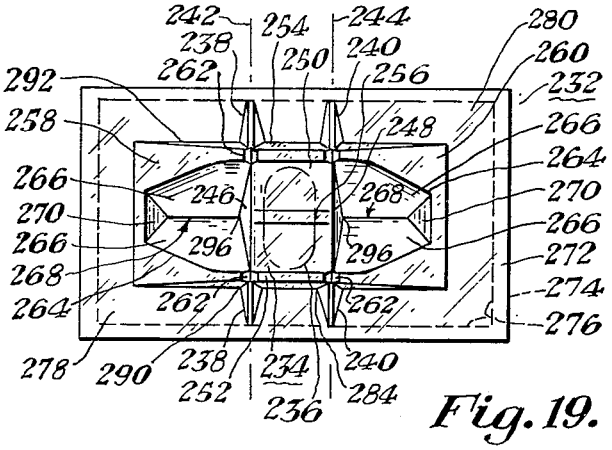
Fig. 19.
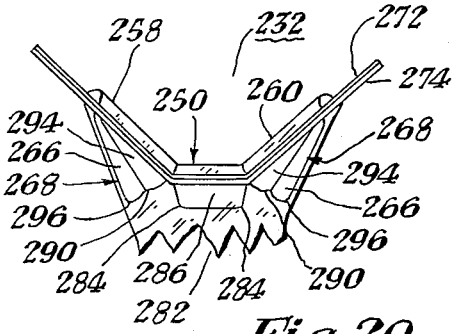
Fig. 20.
Fig. 21.
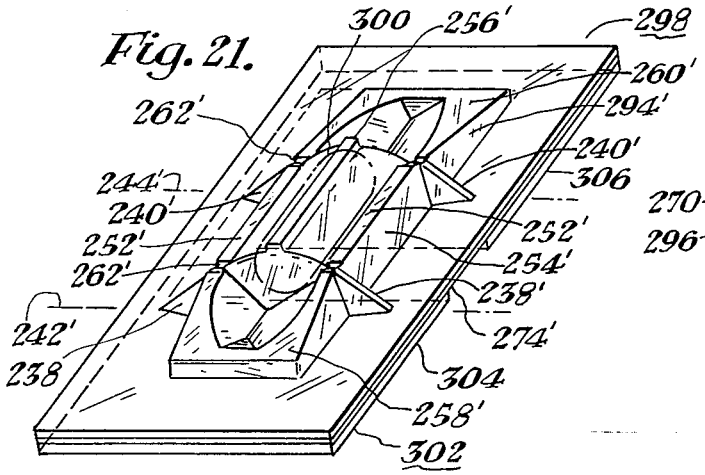
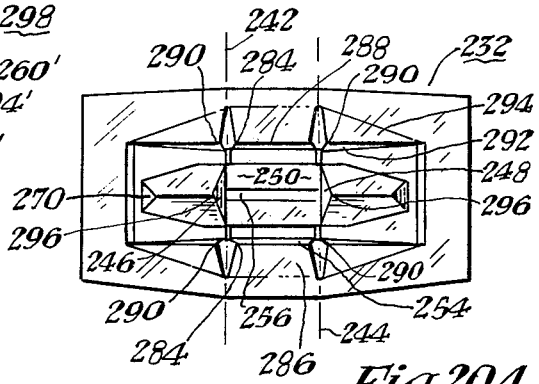
Fig. 20A.
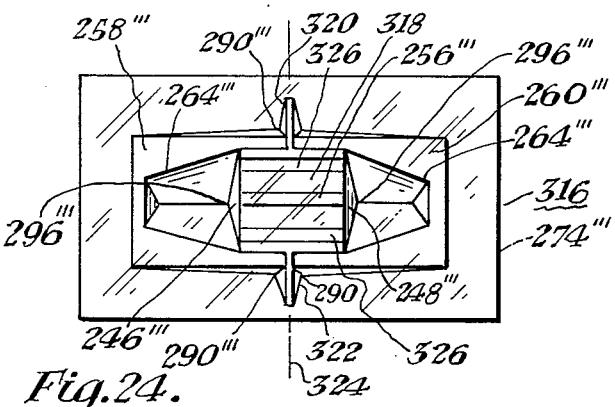
Fig. 24.
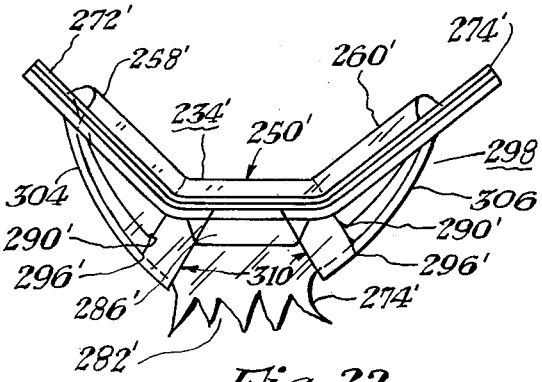
Fig. 22.
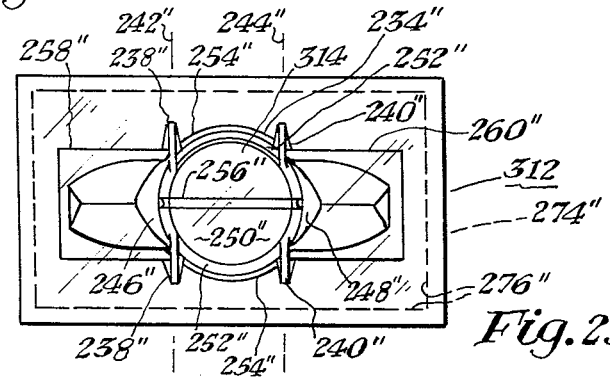
Fig. 23.

CHILD-PROOFED QUICK-OPENING PACKAGE

The present invention relates to quick-opening angulatable packages generally of the types disclosed and claimed in my Pat. Nos. 3,472,367; 3,472,368; 3,540,579; and 3,689,458. More particularly, the present invention contemplates force-modifying arrangements for controlling the angulating or other opening characteristics of such packages and also unique protective arrangements therefor. The invention is especially directed to use of the disclosed force-modifying and protective arrangements for child-proofing purposes.

The advantages of quick-opening packages for various types of contained items have been covered in may aforementioned patents. The packages of the present invention are likewise adaptable to one-handed opening operations, although two hands can be employed for this purpose depending upon the size or stiffness of a given package construction. In either event, the advantages of quick opening without spillage or contamination of the contained item or items are realized with a simple but effective package structure. In addition my novel packages can be made relatively large or relatively small depending upon the size of specific items to be packaged therein. Liquids, as well as granualr or powdered solids, also can be packaged and the contained item, whether fluid or solid, can be readily inspected through the package when conveniently fabricated from transparent components.

Important features of the present invention are the provision of novel means for unexpectedly enhacing the child-proofed aspect of the packages described and claimed in my aforementioned patents. A basic amount of child-proofing is afforded by the unique hand or finger movements, required in opening my previously disclosed packages. Such opening movements are not readily apparent to children, particularly very small children, who are thus not able to manipulate the package. Moreover, very small children do not have the physical strength usually necessary to tear open the package by brute force. Older children may of course possess the necessary force, or they can open the package by biting.

A package that a five year old cannot open could be easily opened by an adult if the opening forces are properly arranged. A child could bite into the package having a thin aluminum foil or material of similar strength as a backing layer. In accordance with one feature of my invention I provide one or more additional layers having a definite line or lines of frangibility or weakening in cooperation with the frangible layer. The outer, protective layer or layers prevent a childs biting through the package.

My invention unexpectedly provides means for modifying the frangibility and the attendant opening forces of the package components, particularly in the region of the angulation fold produced when the package is opened. This modifying means can provide a degree of manual strength or dexterity to open the package beyond that posessed by children of differing ages, as desired. On the other hand the packages of the present invention can be opened readily by the average adult.

The child-proofing means also renders the package much less susceptible to biting into or through by small children. In this respect protection particularly for the frangible component of the package is afforded.

In conjunction with the child-proofing means of the invention or as part thereof, I provide a flat, white or other printable surface for inscribing the desired information as to the manner of opening the package or the ingredients contained therin. This feature of the invention is highly desirable in that the usual blister material or a frangible plastic when used for the backing layer does not lend itself well to the application of such indicia.

I accomplish the aforementioned beneficial results and overcome the disadvantages of the prior art by providing a quick-opening package comprising a layer of formable material, at least one pocket in said formable layer, a frangible backing layer adhered to said formable layer for enclosing an item contained in said pocket, means for strengthening portions of said formable layer, said strengthening means defining an angulation fold line extending between said portions and across said pocket, and a layer of protective material adhered at least peripherally to a side of said frangible layer opposite from said formable layer, said protective layer having a line of weakening therein extending adjacent to and generally parallel with said fold line.

I also desirably provide a similar package wherein said line of weakening terminates short of the adjacent edges of said protective layer.

I also desirably provide a similar package wherein said line of weakening extends eccentrically of said pocket.

I also desirably provide a similar package wherein said strengthening means include a relatively stiff portion of said protective layer on each side of said line of weakening.

I also desirably provide a similar package including an item contained in said pocket and protruding therefrom, said frangible backing layer and said protective layer being lightly stretched over said item and peripherally secured to said formable layer.

I also desirably provide a similar package including a second protective layer coextending uninterruptedly over the first-mentioned protective layer to conceal said line of weakening and to afford a surface for application of indicia.

I also desirably provide a similar package including a second protective layer covering the first-mentioned protective layer, said second protective layer having a line of weakening therein extending generally parallel to the line of weakening of said first-mentioned layer, said second line of weakening being displaced laterally of said first-mentioned line of weakening.

I also desirably provide a quick-opening package comprising a layer of relatively thick formable material, at least one pocket formed in said formable layer, a frangible backing layer adhered to said formable layer for enclosing an item contained in said pocket, means for strengthening portions of said formable layer, said strengthening means defining an angulation fold line extending between said portions and across said pocket, and pocket stiffening means secured to a top wall of said pocket and extending thereacross in a direction generally normal to said fold line to minimize or prevent angulation of said pocket wall.

I am aware of a number of patents of general interest in the quick-opening package art, as follows:

| | |
|---|---|
| Wertepny, Jr. | 2,874,836 |
| Hartman, Jr. et al | 3,054,503 |
| Sparks | 3,207,299 |

-continued

| | |
|---|---|
| Bundy | 3,176,743 |
| Blum | 2,078,227 |
| Tjaden | 3,397,774 |
| Capezzuto | 3,127,010 |
| Szotek | 3,463,309 |
| Rasmussen et al | 3,035,691 |
| Lingley | 3,075,639 |
| Middleton, Jr. et al | 2,892,538 |
| Lockwood | 3,216,562 |
| Hoag | 2,499,313 |
| Ward | 3,521,805 |
| Look, Jr. | 2,927,689 |
| (British) | 157,358 |
| (British) | 912,055 |
| (British) | 1,081,502 |
| (Jap. Ut. M. Publ.) | 20483/62 |

None of the foregoing patents, nor any combination thereof, however discloses the novel features of my invention as set forth above.

During the foregoing discussion, various objectives features and advantages of the invention have been set forth. These and other objectives, features and advantages of the invention together with structural details thereof will be elaborated upon during the forthcoming description of certain presently preferred embodimentts of the invention and presently preferred methods of practicing the same.

In the accompanying drawings I have shown certain presently preferred embodiments of the invention and have illustrated certain presently preferred methods of practicing the same wherein:

FIG. 1 is an isometric view showing one arrangement of my child-proofed package acording to the invention;

FIG. 2 is a cross-sectional view taken along reference line II—II of FIG. 1 and showing the package in its opened condition;

FIG. 2A is a sectional view of a similar package wherein the backing layers are lightly stretched over the contained item;

FIG. 3 is a bottom plan view of a modified form of my novel child-proofing means;

FIG. 4 is an isometric view of the package of FIG. 3 in its opened condition;

FIG. 5 is a bottom plan view of still another form of my novel package and child-proofing means;

FIG. 6 is a similar view showing a positional modification of the child-proofing means;

FIG. 7 is an isometric view of the FIG. 6 package in its opened condition.

FIG. 19 is a top plan view of another form of my novel package incorporating a novel arrangement for spreading portions of the pocket and modifying the opening characteristics of the package;

FIG. 20 is a side elevational view of the package of FIG. 19 in its opened condition;

FIG. 20A is a bottom plan view of the package shown in FIGS. 19 and 20 in the open condition thereof, with the frangible layer removed for clarity;

FIG. 21 is an isometric view of a modified form of the package shown in FIGS. 19 and 20 and incorporating one arrangement of the child-proofing feature of the invention;

FIG. 22 is an elevational view of the package of FIG. 21 in its opened condition;

FIG. 23 is a top plan view of a modified form of my novvel package illustrated in FIGS. 19–20A; and FIG. 24 is a top plan view of still another modification of the package shown in FIG. 19.

Figure 8:
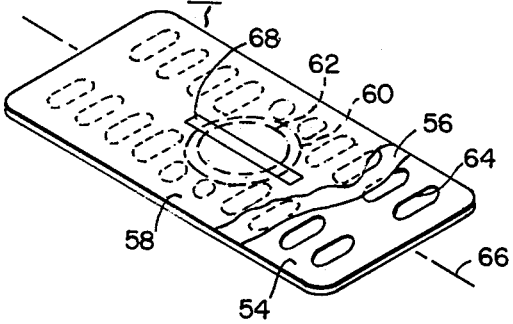
FIG. 8 is an isometric view, partially broken away, of still another form of my novel, child-proofed package.

Referring now to FIGS. 1 and 2 of the drawings the exemplary form of my invention shown therein comprises a child-proofed package 20 having in this example a layer 22 of blister or other formable material in which is formed a pocket 24 and stiffening ribs or members 26, for example after the manner of my aforementioned Pat. No. 3,689,458.

Briefly, stiffeners 26 and the adjacent package portions spread the walls of blister 27 when the package 20 is angulated. This spreading action is concentrated at the blister extensions or end portions **27*a*, 27*b* as by junction with the adjacent ends 23, 25 of the stiffeners 26 respectively. Rupture of an overlying frangible layer or backing, such as the aluminum layer 28 described below, is initiated at one or both of these blister extensions 27*a*, 27*b***.

It will be readily apparant, however, that the principles of others of my aforementioned patents can be utilized instead, in formulating the basic, angulatable package structures of the present invention. Some of these principles, in combination with those of the present invention, are discussed below.

Overlying the blister layer or relatively rigid member 22 is a backing member including a sheet 28 of frangible material such as aluminum foil. The foil 28 can be covered with a thin layer of a suitable heat-sealable plastic such as polyethylene so that the aluminum foil layer 28 can be heat-sealed in the conventional manner to the blister material 22. Alternatively a suitable and known adhesive can be employed.

Secured to the outer surfaces of the frangible layer 28 and completing the backing protective portions 30, 32 which can be applied in any suitable manner to the frangible member 28. In this example of the invention the protective portions 30, 32 desirably are not frangible per se and thus can be fabricated from a heavy paper, a lightweight cardboard, a plastic material such as PVC, or the like. The protective members 30, 32 can be adhered or otherwise applied to the frangible layer 28 in any convenient fashion as by the use of applied glue or adhesive, or by heat-sealing such that the relatively non-rupturable portions 30, 32 cannot be peeled off by a very young child.

The frangible layer 28 can be peripherally sealed to the blister layer 22, or alternatively the layer 28 can be flush-sealed to the planar areas of the blister layer 22. Likewise, the protective members 30, 32 can be peripherally or flushly sealed to the frangible layer 28. The simultaneous and peripheral heat-sealing of these components is the most feasible assembly procedure at least for many types of production equipment. On the other hand flush sealing of these components tends to stiffen the package and to increase the rupture forces exerted upon the frangible layer 28, when the package is angulated.

In the arrangement shown in FIGS. 1 and 2 the protective portions 30, 32 are dimensioned such that a gap 34 (which can be a slit or a slot or a series of slits or slots) of preselected width remains between the adjacent edges of the protective members 30, 32. The width of the gap 34 can be varied depending upon the desired opening characteristics of the package. Thus, a wider gap 34 lends less resistance to angulation of the package 20 (FIG. 2) while a narrower gap or a mere slit such as shown in FIG. 3 progressively strengthens the package against angulation, so that greater opening forces are required. Thus, the opening forces of the package 20 can be adjusted to prevent opening by children of various ages, while at the same time permitting the package to be opened comfortably by the average adult. Such gap or slit or elongated slot (e.g. FIGS. 8 and 9) is referred to generally herein as "narrow opening means" or "band of frangibility".

Use of the protective members 30, 32, of a preselecteed stiffness or toughness, also lessens the likelihood that a very young child will attempt to bite or pick through or into the package 20. Of course, the narrower the gap 34 the more the package 20 and its contents are protected from this type of activity, also. In any event, the narrow opening means or band of frangibility 34 is of insufficient width to emit the contained item in the unangulated condition of the package 20.

When the package 20 of FIG. 1 is opened as shown in FIG. 2, the frangible member or layer 28 is ruptured in the area thereof exposed at the gap 34. The backing member (including in this case the frangible layer 28 and the relatively non-rupturable portions 30, 32) of the package 20 is of spatially limited frangibility and can only break at the narrow band of frangibility 34 insofar as angulating the package and dispensing a contained item are concerned. As the narrow opening means or gap 34 is narrower than the contained item the act of angulating the package 20 tends to spread the juxtaposed edges of the protective portions 30, 32 to permit ready extraction of the contained item. The spreading of these edges is covered more fully below in connection with FIGS. 4 and 7 of the drawings.

The package 20*a* of FIG. 2A is similar in construction to the package 20 of FIGS. 1 and 2 save that the frangible layer 28' together with the protective members or layer 30', 32' are lightly stretched over the contained item 36 and in contact wherewith so that when the package 20*a* is angulated as part of its opening sequence the pressure of the contained item 36 against the frangible layer 28' aids in rupturing the frangible layer and in spreading the adjacent of the protective members of layer 30', 32' as required.

A similar package is shown in FIGS. 3 and 4 of the drawings wherein the protective members or layers 30–32 FIGS. 1 and 2 are replaceed in angulatable package 20' by protective layer 38 having a central transverse slit 40 positioned generally over the contained item 42 and blister or pocket 24'. The slit 40, extending in this case completely across the protective layer 38, can in addition extend partially or completely through the thickness of the layer 38. When the package 20' is opened (FIG. 4) the edges 44, 46 of the protective layer 38 adjacent the slit 40 are spread sufficiently to permit removal of the contained item 42.

The protective layer 38, if desired, can be provided with a multitude of additional slits, as denoted by chain outlines 48 thereof in FIG. 3, so that the protective layer 38 need not be precisely positioned with respect to the item 42 and the blister of pocket 24'. Where the additional slits 48 are thus provided, the protective layer 38 becomes endowed with a directional frangibility.

FIGS. 5 and 6 illustrate similar packages 20'*a* and 20'*b* respectively in which the transverse slit 40'*a*, 40'*b* thereof respectivly do not extend entirely across the protective layer 38'*a* or 38'*b*. This arrangment further increases the opening forces of the packages 20'*a* or 20'*b*, as the non-slitted areas 50*a*, 50*b* at the ends of the slits 40'*a*, 40'*b* respectively usually must be ruptured along with the underlying frangible layer, when the package 20'*a* or 20'*b* is angulated.

The opened condition of the package 20'*a* (FIG. 5) is essentially similar to that shown in FIG. 4 and thus is not further illustrated not described. In the package 20'*b* of FIG. 6, however, the slit 40'*b* while extending across the blister 27'', is nevertheless located eccentrically of the item 42''. When the package 20'*b* of FIG. 6 is opened, as shown in FIG. 7, portions of the areas 50*b* usually are torn away from the underlying areas of the package 20'*b*, as shown in FIG. 7. This makes the contained item 42'' more accessible, and the opening forces of the package 20'*b* of FIGS. 6 and 7 are increased still further and advantageously relative to the opening forces of the package 20'*a* of FIG. 5.

In FIG. 8 of the drawings a modification of the child-proofing feature of the invention is shown in conjunction with one of the packages described and claimed in my Pat. No. 3,472,367. The child-proofed package 52 of FIG. 8 includes a layer of blister or other formable material 54 having a backing layer of frangible material such as aluminum foil 56. Overlying the backing layer 56 is a protective layer 58, which can be fabricated from one of the materials mentioned above in connection with the protective members 30, 32 of FIGS. 1 and 2. The blister layer 54 includes a pocket 60 having item 62 contained therein and a number of stiffening ribs, ridges or indentations 64. The stiffeners 64 define a line of angulation of fold line 66 along which the package 52 is angulated during the opening procedure. As set forth in the last-mentioned patent, the pressure of the item 62 against the frangible layer 56 when the package 52 is angulated can aid in rupturing the frangible layer 56.

A slit or slot 68 is cut into the protective layer 58 and is generally centered with respect to the pocket 60. The slit or slot 68 exposes more or less of the frangible layer 56 in the region of the pocket 60. When the package 52 is angulated the edges of the slit or slot 68 tends to spread as shown in FIGS. 2 ans 4 in providing dispensing access to the item 62.

The use of the rather stiff protective layer 58 increases the opening forces of the package 52, and in that respect makes opening of the package 52 less accessible to young children.

The slit or slot 68 can be longer or shorter than shown, so long as it extends substantially across the pocket 60. By shortening the slot 68 the opening forces of the package are increased. These forces likewise can be increased by substituting stiffer material in the protective layer 58. As intimated, the slot 68 can be of varied widths, and can be a mere slit after the manner of FIGS. 3–7. Where the protective layer 58 is sufficiently stiff to define (with the slit or slot 68) the angulation fold line 66, it is contemplated that the stiffeners 64 can be omitted. On the other hand, upon inclusion of the stiffeners 64 as shown, or theeir equivalents the protective layer 58 can be a layer of tough but thin plastic sufficient to prevent a child's biting or poking its finger into the package. In the cases of very young children the angulational opening procedure will remain a mystery. In any event even a layer of tough, flexible plastic serving as the protective layer 58 will increase the opening forces of the package.

Figure 9:
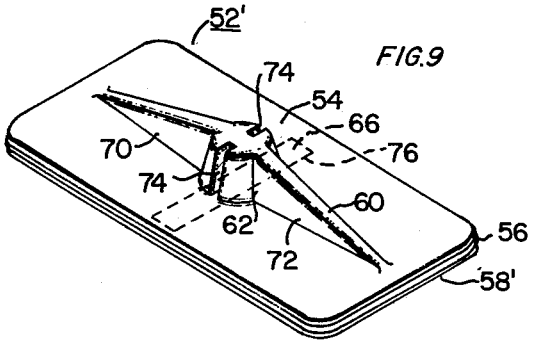
FIG. 9 is a similar view of still another form of my novel package.

In the package 52' of FIG. 9, protective features of my present invention are illustrated in connection with the quick-opening package described and claimed in my Pat. No. 3,472,368. Basically, the package 52' differs from the package 52 of FIG. 8 in that the wing sections 70, 72 of the pocket 60' serve to strengthen the angulatable portions of the package 52' and, with one or more notches 74, define an angulation fold line 66' of the package 52. When the protective layer 58', which can be fabricated as stated above, contains a slot 76 extending transversly of the package 52' and generally along its fold line 66', the package 52' upon angulation opens after the manner shown for example in FIG. 2. Alternatively, the slot 76 can be a mere slit in which case the package 52' will open after the manner of FIG. 4 or FIG. 7. It will also be understood that the slot or slit 76, as indeed with any of the packages described and claimed herein, can be placed off center of the pocket or item substantially as shown in FIGS. 6 and 7.

Figure 10:
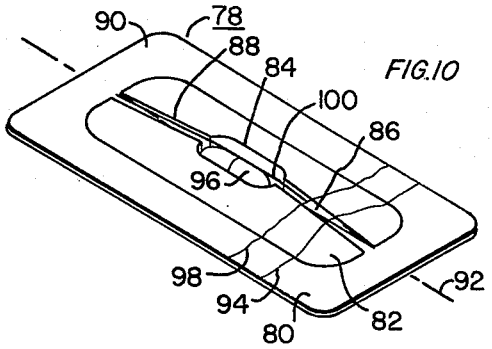
FIG. 10 is a similar view of still another form of my novel package.

In FIG. 10 the novel features of my present invention are illustrated in conjunction with one of the packages described and claimed in my Pat. No. 3,540,579. The package 78 of FIG. 10 includes a relatively stiff, formed base number 80 having a generally central raised portion 82 which is further formed to define an item-containing pocket 84 and a pair of angulation notches 86, 88. The bottoms of the notches 86, 88 and desirably also of the pocket 84 most advantageously lie at or near the plane of the outer peripheral area 90 of the base member 80 to facilitate angulation of the package 78 along fold line 92. Such angulation ruptures a frangible layer 94 which is lightly stretched over the pocket 84 and the raised portion 82 of the base member 80 and adhered by gluing or heat sealing to the peripheral areas 90 of the package 78. As in the case of the frangible layers mentioned in connection with the preceeding Figures, the integrity of this layer, since it contains no line of weakening to facilitate per se the opening of the package, serves as a barrier against moisture and other foreign matter which may contaminate contained item 96.

A protective layer 98 in turn is lightly stretched over and at least the frangible layer 94 is peripherally joined to the package 78. The protective layer 98 can be heat-sealed, glued or otherwise joined to the peripheral areas 90 of the package 78. Alternatively the layer 98 can be provided with a coating of pressure sensitive adhesive for adhering directly to the frangible layer 94. In any event, the angulational force during opening of the package 78 is increased, while the protective layer 98 is provided with a slit 100 generally overlying the pocket 84 and the notches 86, 88 of the package 78. As in the previously described packages, the slit 100 together with the frangible layer 94 and the protective layer 98 define a line of weakening as it were, along which rupture occurs when the package 78 is angulated.

Figure 11:
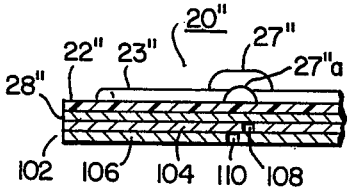
FIG. 11 is a partial longitudinally sectioned view showing a uniquely laminated child-proofed package structure.

Another protective or child-proofing arrangement is shown in FIG. 11 and can be utilized with any of the packages shown herein or their equivalents. The package 20'' of FIG. 11 is constructed basically after the manner of FIG. 1 and 2 of the drawings and thus includes a blister of formable layer 22'' having a frangible backing layer 28''. Suitable package protection or child-proofing means 102 are provided for the frangible layer 28'', in this example, in the form of two or more protective layers 104, 106.

Each of the protective layers 104, 106 contains a slit or gap 108 or 110, respectively, extending generally across the blister or pocket 27'. Each gap or slit 108 or 110 can be extended entirely across the package as in the case of the gap 34 of FIG. 1 or can terminate short of the edges of the package as in FIG. 8 or FIG. 9 to increase opening forces as explained above with reference to FIGS. 5–7. Desirably the slits or gaps 108, 110 are displaced laterally from one another to increase further the package opening forces and to lend additional protection to the underlying frangible layer 28''.

Figure 12:
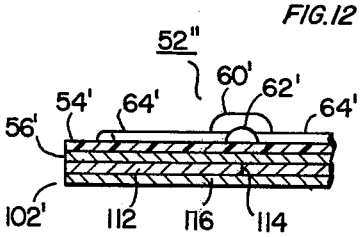
FIG. 12 is a longitudinally sectioned view similar to FIG. 8 but having a modified form of child-proofing means with a protective overlay.

Another multi-layered protective arrangement 102', according to the invention, is illustrated in FIG. 12 of the drawings. The basic package structure 52'' of FIG. 12 is similar to that described previously in connection with FIG. 8 and includes a layer of blister or other formable material 54' and a frangible backing layer 56'. One form of the aforementioned protective means 102' includes a first layer 112 extending coextensively with the frangible layer 56' and having a gap or slit 114 therein. The slit 114 extends along the intended angulation fold line, such as the line 66 in FIG. 8, for the purposes explained previously in connection with the elongated gap 68 in FIG. 8. The slit 114 can extend entirely across the package as in FIG. 3 or it can terminate short of the adjacent edges of the package as in FIG. 5 and other figures.

Extending uninterruptedly over the protective layer 112 is a second protective layer 116. The layer 116 is fabricated from a frangible material such as paper, or lightweight aluminum and therefore, does not require a gap or slit or line of weakening of any kind. The outer protective layer 116 need not necessarily serve as a barrier against moisture or other contamination, which is the function of the inner frangible layer 56'. Primarily, the outer protective layer 116 conceals the existence of the gap or slit 114 and renders the manner of opening of the package 52' even less apparent. In addition, the outer protective layer 116 serves as a suitable base for the application of printing or other indicia to the package 52'.

Figure 13:
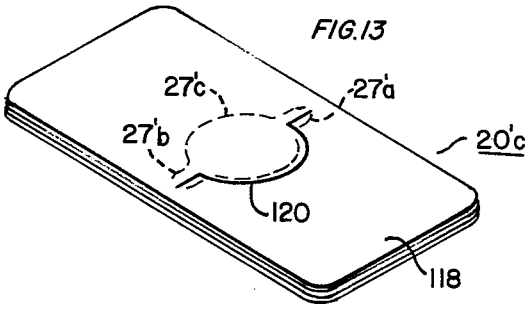
FIG. 13 is an isometric view of a modified form of the child-proofing means shown in FIG. 5.
Figure 13A:
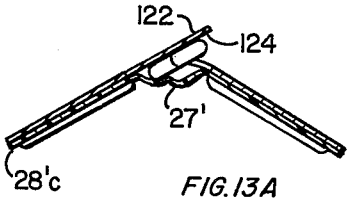
FIG. 13A is an elevational view of the package in FIG. 13 in its opened condition.

Illustrated in FIGS. 13, 13A is a package similar to that shown in FIGS. 5–7 of the drawings. The package 20'c includes an overlying protective layer 118 having in this case a non-linear gap or slit 120. The slit 120 extends between the rupture initiating areas 27a' of the blister or pocket 27'c (described in FIG. 1), but follows generally the lateral contour of one side of the blister or pocket 27'c, as better shown in FIG. 13. Accordingly when the package 20'c is opened (FIG. 13A) the slit 120 defines a tab 122 which rises from the pocket 27'c to expose a major portion of the area thereof and the item or items contained therein. The tab 122 carries with it an underlying portion 124 of the frangible layer 28'c all of which facilitates extraction of a contained item or items from the pocket 27'c. To facilitate the raising of the protective layer tab 122, as shown in FIG. 13A, the protective layer 118 can be fabricated from a ralatively stiff material such as heavy paper or cardboard.

Figure 14:
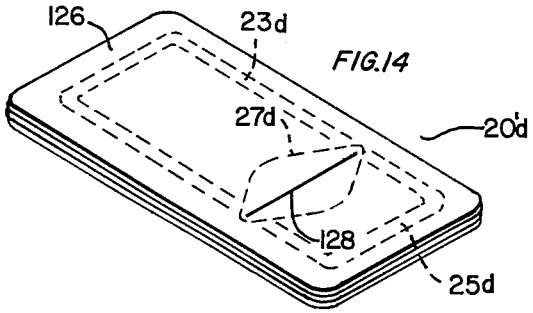
FIG. 14 is an isometric view of still another form of my novel child-proofed package.

In my child-proofed package 20'd of FIG. 14 a package structure similar to that illustrated in FIG. 6 is shown. However, the pocket 27d and associated components of the package 20'd are located eccentrically of the package to complicate further the opening procedure and to increase the opening forces of the package 20'd. This follows from the use of long and short angulatable portion including respectively elongated stiffener 23d and the foreshortened stiffener 25d. The package 20'd is likewise provided with a protective layer 126 having a slit 128 therein extending longitudinally of the fold line as determined by the elongated pocket 27d. If desired the gap or slit 128 can be located eccentrically of the pocket 27d after the manner of FIG. 6.

Figure 15:
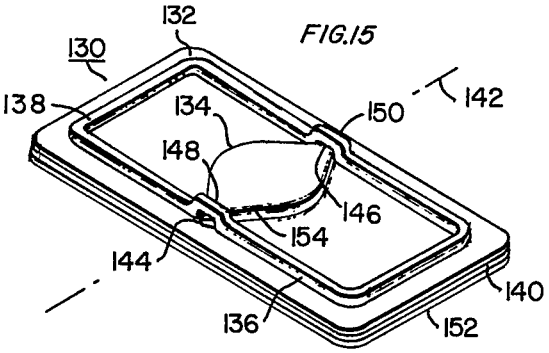
FIG. 15 is an isometric view of still another form of my novel child-proofed package.

A particularly effacious feature of my invention for increasing the angulating or opening forces of package 130 is shown in FIG. 15. The package 130 includes in this example a blister or formable layer 132 having a blister or pocket 134 and stiffening ribs or ridges 136, 138. A frangible backing layer 140 formed from an aluminum foil or other frangible material is adhered in the conventional manner to the undersurface (as viewed in FIG. 15) of the blister layer 132. During the opening sequence of the package 130, the package angulates about reference or fold line 142 extending longitudinally of the blister 134 and its end portions or extensions 144, 146. The opening sequence of the package 130 is essentially that as described above with reference to FIGS. 1 and 2 and the rupture initiating portions 27a, 27b of the package 20. However, the ends of the angulating or stiffening ridges 136, 138 (which are coupled to the pocket end portions) are bridged at their junctions with the pocket end portions or 144, 146 by means of stiffening elements or ridge sections 148, 150 extending respectively across the end portions 144, 146 and adjoining the adjacent end portions of the stiffening ridges 136, 138. The ridge sections 148, 150 lend additional resistance to the bending or angulation of the package 130 about the fold line 142. Accordingly, the opening forces of the package 130 are increased in dependence upon the stiffness of the ridge portions 148, 150, the rigidity of their junction with the stiffening ridges or members 136, 138 and the thickness or stiffness of the blister layer 132 from which the ridge portions 144, 146 and associated components are formed.

In further accordance with my present invention, the undersurface of the frangible layer 140 (as viewed in FIG. 15) can be covered by a protective layer 152 having a gap or slit 154 therein and extending longitudinally of the blister or pocket 132. If the layer 152 is provided with a gap in place of a slit, the package 130 will open after the manner of FIG. 2. On the other hand if the protective layer 152 is provided with a slit as shown then the package 130 will open after the manner of FIG. 4, or 13A.

Figure 16:
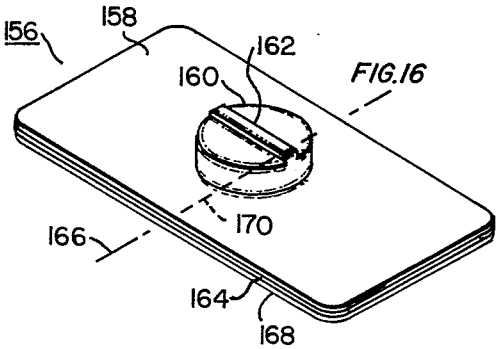
FIG. 16 is an isometric view of still another form of the novel child-proofed package of the invention.

In FIG. 16, still another arrangement is illustrated according to the invention for modifying the opening of package 156. The package 156 likewise includes a layer of blister or other formable material 158 having a pocket 160 therein, with the pocket having a rigidizing bar or ridge 162 extending across the top wall of the pocket to minimize or prevent altogether any angulation or buckling of the pocket top wall. The bar 162 can be applied as a discrete member adhered to the top of the pocket 160, or alternatively and preferably the bar or ridge 162 can be formed therein from the blister material 158 simultaneously with forming of the pocket 160.

A frangible backing layer 164 is adhered to the underside of the blister layer 158 and is ruptured in the area of the pocket 160 (after the manner of the angulatible package described and claimed in my Pat. No. 3,472,367), when the package 156 is angulated about fold line 166.

In further accordance with this feature of the invention a protective and stiffening layer 168 is adhered to the underside of the frangible layer 164, for example in the manner described above with respect to one or more of the preceding figures. The protective and stiffening layer 168 can be fabricated from cardboard or other suitable material having the requisite stiffness, or alternatively from one of the other protective materials mentioned above, in which case suitable stiffening means can be formed in or adhered to the blister layer 158 after the manner of FIG. 8. In any event the protective and stiffening layer 168 is provided with a transverse slit or narrow slot 170 extending generally across the pocket 160 and whatever item is contained therein. The slit or slot 170 permits opening of the package 156 after the manner of FIG. 2 or 4 hereof, and in addition affords a line of weakening along the intended fold line 166 of the package 156, in the absence of other angulation determining means such as the stiffening ridges 64 of FIG. 8. Opening of the package 156 is variously resisted by the presence of the pocket ridge 162, depending upon the height of the ridge 162 and the stiffness of the material from which it is formed. More importantly the tendency of the top pocket wall to angulate or buckle is largely prevented. The contained item is not pushed or "popped" through the frangible layer. An uncontrolled dispensing of the item is thereby avoided.

Figure 17:
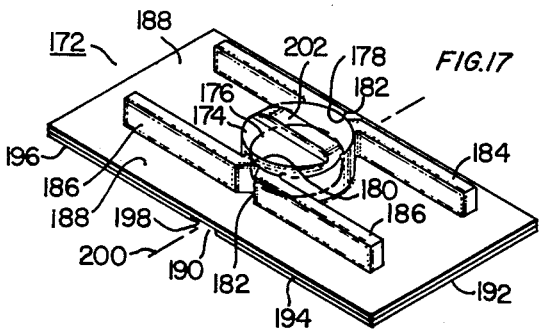
FIG. 17 is an isometric view of still another form of my novel package having novel means for modifying the opening characteristics of the package.

Another arrangement according to the invention for modifying the opening characteristics of my package is illustrated in FIG. 17 of the drawings. In the package 172 a blister or pocket 174 containing an item 176 is provided with end extension means 178, 180. Each of the end extension means is notched or bifurcated at 182 adjacent the junction of the end extension means 178 or 180 with stiffening means including the rib or ridge members 184, 186 respectively.

Blister layer 188, from which the pocket 174 and the stiffeners 184, 186 are formed integrally in this example, is confronted with an underlying (as viewed in FIG. 17) frangible layer 190, which can be fabricated as noted previously. The frangible layer can be heat-sealed peripherally to the blister layer 188 or alternatively can be joined flushly to the planar areas thereof (excluding the pocket 174 and the stiffeners 184, 186).

Underlying the frangible layer 190 is a protective layer 192 arranged in this example from a pair of discrete protective members 194, 196. The protective members 194, 196 thus are provided after the manner of the protective members 30, 32 of FIG. 1 and define a rupture gap 198 therebetween. Each of the protective members 194, 196 likewise can be peripherally heat-sealed or otherwise secured to the adjacent frangible layer 190, or alternatively the protective members can be flushly adhered thereto.

According to the present understanding of the invention, the presence of the notches 182 in the pocket extension means or end portions 178, 180 enhances the concentration of the opening forces in that portion of the frangible layer 190 which is immediately juxtaposed to the pocket 174. In particular, concentration of opening forces adjacent end portions of the pocket 174 is enhanced as the package 172 is angulated about fold line 200.

The pocket 174 can be provided with a top wall stiffener 202 for the purpose described previously in connection with FIG. 16.

Figure 18:
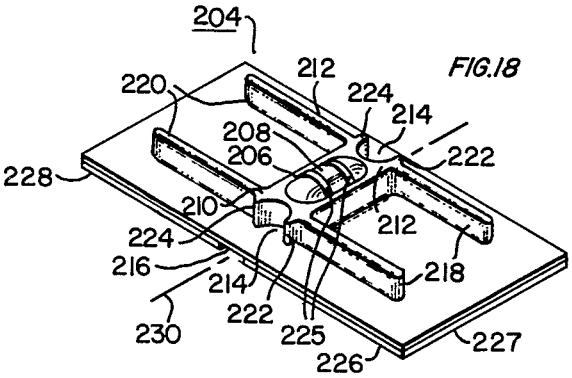
FIG. 18 is an isometric view of a modified form of the opening modifying means of the preceding figure.

A similar arrangement is illustrated in FIG. 18 wherein package 204 is provided with a more elongated pocket 206 shaped to contain an elongated item such as capsule 208. The end extension means 210, 212 of the pocket 206 are more deeply and discretely bifurcated at 214 to further concentrate the package opening forces in that area of the frangible layer 216 which is immediately juxtaposed to the pocket 206.

Similar stiffening means including integrally molded ribs 218, 220 are joined to the end extension means after the manner of the preceding figures, excepting that the stiffeners 218 respectively adjoin the adjacent bifurcations 222 of the end extension means 210, 212, while the stiffeners 220 respectively adjoin the bifurcations 224 thereof. Owing to its elongated configuration the pocket 206 can be provided with a pair of top wall stiffeners 225, after the manner of FIGS. 16 and 17.

The package 204 similarly is provided with protective layer 227 and members 226, 228. It will be understood that the protective layer 192 of FIG. 17 or the protective layer 227 of FIG. 18 can be provided with a single protective member having a slot or elongated slit therein as in appropriate ones of the preceding figures. Alternatively again, the protective members 194, 196, or 226, 228 can be abutted, for example as in FIG. 3, to form in effect a slit therebetween rather than the gap as illustrated.

When the package 204 of FIG. 18 is angulated about fold line 230 it is found that the opening forces of the package 204 are so concentrated by the bifurcated end extension means 210, 212 of the pocket 206, that the frangible layer 216 is ruptured almost explosively. It appears that such flush sealing, when employed, aids in spreading the sidewalls of the pocket 206 to further concentrate thereat the opening forces of the package.

From the foregoing it will be seen that a novel and efficient child-proofed quick-opening package has been described. The descriptive and illustrative materials employed herein are utilized for purposes of exemplifying the invention and not in limitation thereof. Accordingly, numerous modifications of the invention will occur to those skilled in the art without departing from the spirit and scope of the invention. Moreover, it is to be understood that certain features of the invention can be used to advantage without a corresponding use of other features thereof.

I claim:

1. A child proof quick-opening package comprising a member of formable material, at least one pocket in said formable member, a frangible backing member adhered to said formable member for enclosing an item contained in said pocket, means for strengthening portions of said formable member, said strengthening means defining an angulation fold region extending between said portions and across said pocket, and a non-rupturable protective member adhered at least peripherally to a side of said frangible member and substantially coextending therewith, said protective member having narrow opening means therein extending substantially across said protective member and generally parallel with said fold region, said narrow opening means having insufficient width to emit said item in the non-angulated condition of said package.

2. The combination according to claim 1 wherein said narrow opening means include a continuous slit across said protective member.

3. The combination according to claim 1 wherein said narrow opening means terminate short of the adjacent edges of said protective member to increase the forces of angulation.

4. The combination according to claim 1 wherein said narrow opening means include an elongated narrow slot in said protective member.

5. The combination according to claim 1 wherein said narrow opening means extend eccentrically of said pocket.

6. The combination according to claim 5 wherein said narrow opening means are juxtaposed along a lateral edge of said pocket to facilitate extraction of said item upon opening of said package.

7. The combination according to claim 1 wherein said strengthening means include relatively stiff portions of said protective member on each side respectively of said angulation fold region.

8. The combination according to claim 1 wherein said pocket is elongated, and said strengthening means include stiffening members secured respectively to said formable layer portions and coupled to at least one end portion or extension of said pocket for stress concentration upon angulation of said package, the narrow opening means in said protective layer having an end portion juxtaposed to the junction between said pocket and said stiffening members.

9. The combination according to claim 1 wherein a plurality of said narrow opening means are spaced along said protective layer to provide unidirectional frangibility therein.

10. The combination according to claim 9 including said unidirectional frangibility provided by a series of generally parallel slits, said series coextending with said protective layer.

11. The combination according to claim 1 including at least one notch in said pocket and disposed along said fold line or said narrow opening means.

12. The combination according to claim 11 wherein said strengthening means include a pair of pocket extensions in said formable layer and extending generally normally of said narrow opening means.

13. The combination according to claim 1 including said formable member having a relatively stiff characteristic, a raised portion formed therein, said pocket being formed in said raised portion, a pair of angulation fold-initiating notches adjoining said pocket and formed in said raised portion, said notches extending along said angulation fold region, said frangible member and said protective member being lightly stretched over said raised portion and joined at least peripherally to said formable member.

14. The combination according to claim 1 including an item contained in said pocket and protruding therefrom, said frangible backing member and said protective member being lightly stretched over said item and peripherally secured to said formable member.

15. The combination according to claim 1 including a frangible member coextending uninterruptedly over said protective member to conceal said narrow opening means.

16. The combination according to claim 1 including a second non-rupturable member covering the first-mentioned protective member, said second protective member having narrow opening means extending generally parallel to the narrow opening means of said first-mentioned protective member, said second narrow opening means being displaced laterally of said first-mentioned narrow opening means for concealment purposes.

17. The combination according to claim 1 wherein said pocket is rigidized by a stiffening member extending along a top wall thereof and generally normal to said narrow opening means for increasing the opening forces of said package.

18. The combination according to claim 8 including said stiffening members coupled respectively to both end portions or end extensions of said pocket, a stiffening element extending across each of said pocket end portions or extensions and joined substantially rigid to juxtaposed ends of said stiffening members to increase the opening forces of said packages.

19. The combination according to claim 8 wherein said pocket is provided with bifurcated end extension means, and said stiffening members are coupled respectively to the bifurcations of said end extension means to increase the rupture forces of said package.

20. The combination according to claim 19 wherein the bifurcations of said end extension means are spaced from one another across the width of said pocket to enhance further said rupture forces.

21. The combination according to claim 20 wherein end extension means are provided at each end of said pocket, and the bifurcations thereof extend generally parallel from each end of said pocket.

22. A child-proof package comprising a pair of encapsulating members, one of said members being relatively rigid, the other said members being frangible, an item for dispensing positioned within an area enclosed by said members, said frangible member being joined about its periphery to said relatively rigid member, the structural strength of said relatively rigid member being in excess of the rupture strength of said frangible member, means for defining an angulation fold region across at least one of said members and across said item so that said frangible member breaks adjacent said fold region upon angulation of said package to expose said item at said fold region for dispensing purposes, and a non-rupturable protective member secured to said frangible member and coextending substantially therewith, said protective member having narrow opening means therein extending substantially across said protective member and generally parallel with said fold region, said narrow opening means being of insufficient width to emit said item in the unangulated condition of said package, each of said protective member and said rigid member having sufficient structural strength as to preclude rupturing by a very young child, said rigid member in addition having sufficient structural rigidity as to resist angulation of said package by a very young child.

23. The combination according to claim 22 wherein said protective member includes a sheet of tough plastic having a coating of pressure sensitive adhesive thereon for adhering to said frangible member.

24. The combination according to claim 22 wherein said frangible member is a sheet of aluminum foil having a thin coating of heat sealable plastic thereon at least on the surface towards said protective member, said protective member being a sheet of heat sealable plastic and heat sealed to said frangible member.

25. The combination according to claim 22 wherein said narrow opening means include a slit in said protective member.

26. A child-proof quick-open package comprising a pair of encapsulating members, one of said members being relatively rigid and non-rupturable, said members being joined together at least at their peripheral edges for enclosing an item for dispensing contained therein, means for defining an angulation fold region extending across said item, the other of said members having a narrow band of frangibility extending thereacross and generally across said item, said frangible band being generally parallel to said angulation region and extending between non-rupturable portions of said other member, said frangible band even upon breakage from child-tampering being sufficiently narrow as to preclude passage of said item through said band in the unangulated condition of said package, said rigid member and the relatively non-rupturable areas of said other member having sufficient structural strength as to preclude rupture by child-tampering, and said rigid member together with that portion of said other member adhered thereto having sufficient structural rigidity as to preclude angulation by a very young child, said package upon said angulation, rupturing said frangible band and separating the non-rupturable portions of said other member sufficient to emit said item for dispensing purposes, said other member includes a layer of frangible material on which said frangible band is delineated by a non-rupturable protective layer having a slit or slot therein and secured to said frangible layer, said protective layer being otherwise substantially coextensive with said frangible layer, said protective layer being impervious to rupturing attempts by a very young child.

27. The combination according to claim 26 wherein said other member includes a frangible sheet on which said frangible band is defined by portions of relatively non-rupturable material adherred to said sheet sufficiently tightly as to preclude peeling off by a very young child.

28. The combination according to claim 26 wherein said rigid member and said other member together with the securance therebetween are moisture resistant.

* * * * *